US005979206A

United States Patent [19]

Minnerop

[11] Patent Number: 5,979,206

[45] Date of Patent: Nov. 9, 1999

[54] ROLLING TRAIN

[75] Inventor: Michael Minnerop, Ratingen, Germany

[73] Assignee: SMS Schloemann-Siemag Aktiegesellschaft, Düsseldorf, Germany

[21] Appl. No.: 09/006,704

[22] Filed: Jan. 14, 1998

[30] Foreign Application Priority Data

Jan. 15, 1997 [DE] Germany ..... 197 01 060

[51] Int. Cl.[6] ..... B21B 31/08

[52] U.S. Cl. ..... 72/239

[58] Field of Search ..... 72/238, 239, 234, 72/250, 237

[56] References Cited

U.S. PATENT DOCUMENTS 4,962,657 10/1990 Svagr ..... 72/238
5,050,418 9/1991 Grotepass ..... 72/239

FOREIGN PATENT DOCUMENTS 2823139 11/1979 Germany ..... 72/239

*Primary Examiner*—Rodney Butler
*Attorney, Agent, or Firm*—Friedrich Kueffner

[57] ABSTRACT

A rolling train, particularly a tandem stand group, includes three roll stands, particularly two universal stands and an edging stand, wherein a middle stand of the three stands or the edging stand is moveable out of the stand group transversely of the rolling line for exchanging the roll set and the guide fittings, and wherein the rolling train includes at least one shifting or manipulating platform with roll exchange sets and/or exchange fittings placed on carriages. The shifting platform moveable in rolling direction on the operator side is provided in the exchanging position at the outer sides of the housings of the outer stands with outer rails extending toward the drive side, on the one hand, and with central rails extending in alignment with the middle stand transversely of the shifting platform in the direction of the operator side, on the other hand, wherein the central rails extend beyond the shifting platform, and wherein middle rails extending toward the operator side are provided for each outer stand.

5 Claims, 3 Drawing Sheets

ROLLING TRAIN

BACKGROUND OF THE INVENTION

1. Field of the Invention

The present invention relates to a rolling train, particularly a tandem stand group, composed of three roll stands, particularly two universal stands and an edging stand, wherein a middle stand of the three stands or the edging stand is moveable out of the stand group transversely of the rolling line for exchanging the roll set and the guide fittings, and wherein the rolling train includes at least one shifting or manipulating platform with roll exchange sets and/or exchange fittings placed on carriages.

2. Description of the Related Art

In a rolling train of the above-described type disclosed in EP 0 329 998 B1, which includes two stationary universal roll stand and an edging stand arranged between the universal roll stands, the middle stand, i.e., the edging stand and, thus, the smallest stand of the rolling train, is shifted out of the rolling line toward the operator side for mechanizing the roll and fitting exchange. As soon as the edging stand assumes a position outside of the narrow space available between the two heavy universal stands, the edging stand is easily accessible from all sides, so that the guide fittings can be exchanged without problems. Simultaneously, shifting of the edging stand results in a sufficiently large free space between the universal stands in which assembly and disassembly devices can be used, so that the guide fittings of the universal stands can also be exchanged. However, in this known rolling train, separate shifting platforms and work platforms are required for the roll sets as well as for the guide armatures to be exchanged, so that intersecting travel paths exist. In addition, for changing the roll sets, a shop crane or auxiliary crane is required, wherein the use of this crane may endanger the personnel.

SUMMARY OF THE INVENTION

Therefore, it is the primary object of the present invention to simplify the exchange operations in a rolling train of the above-described type, for example, a continuous train or tandem stand group, without having to use a crane, and to reduce the times required for the exchange.

In accordance with the present invention, the shifting platform moveable in rolling direction on the operator side is provided in the exchanging position at the outer sides of the housings of the outer stands with outer rails extending toward the drive side, on the one hand, and with central rails extending in alignment with the middle stand transversely of the shifting platform in the direction of the operator side, on the other hand, wherein the central rails extend beyond the shifting platform, and wherein middle rails extending toward the operator side are provided for each outer stand.

Consequently, in accordance with the present invention, it is possible to achieve an exchange principle or a manner of assembly and disassembly which does not require separate shifting platforms for the roll sets and for the guide fittings, because all exchange units of the outer stands can be accommodated on a common shifting platform.

After the edging stand has been moved out of the rolling line in the conventional manner, with the shifting platform having been moved in position previously, the guide fittings required for the inner oppositely located sides of the universal stands can be moved in and assembled on the central rails provided for the edging stand. Simultaneously, the guide fittings required for the outer sides of the outer stands can be moved on the outer rails into the mounting position and can be assembled.

In order to produce the free space required on the entry side of the outer stand in the front and on the exit side of the outer stand in the rear, a proposal of the present invention provides that the centering lines arranged in front of and following the outer stands in rolling direction can be moved on the outer rails toward the drive side together with the roller table rollers near the stands.

In accordance with another feature, after the old roll sets have been disassembled, the new roll sets can simultaneously be moved from the shifting platform moved into the ready position on the middle rails into each of the outer stands. The necessary assembly operations on the middle stand moved out of the rolling line can also be carried out without problems because this stand is located remote from the shifting platform.

In accordance with a further development of the invention, exchange platforms for fittings and roll sets of the middle stand are arranged at the central rails in the end portions thereof located next to the shifting platform. Consequently, a simple exchange of the roll sets and fittings is also possible in this stand, since, after moving out the old units and positioning the shifting platforms, the new units are now in alignment for assembly and can be moved by a simple shifting step into the assembly positions.

In accordance with another embodiment of the present invention, a shifting platform for an exchange stand or a housing portion is provided for the central rails in the end portions thereof located next to the shifting platform. In that case, a stand or housing portion which has previously been completely assembled at a different location, i.e., a stand or housing portion provided with all operational units, is moved as a complete unit into the rolling line and merely has to be connected or coupled to the supply lines in this location. the middle rails into each of the outer stands. The necessary assembly operations on the middle stand moved out of the rolling line can also be carried out without problems because this stand is located remote from the shifting platform.

In accordance with a further development of the invention, exchange platforms for fittings and roll sets of the middle stand are arranged at the central rails in the end portions thereof located next to the shifting platform. Consequently, a simple exchange of the roll sets and fittings is also possible in this stand, since, after moving out the old units and positioning the shifting platforms, the new units are now in alignment for assembly and can be moved by a simple shifting step into the assembly positions.

In accordance with another embodiment of the present invention, a shifting platform for an exchange stand or a housing portion is provided for the central rails in the end portions thereof located next to the shifting platform. In that case, a stand or housing portion which has previously been completely assembled at a different location, i.e., a stand or housing portion provided with all operational units, is moved as a complete unit into the rolling line and merely has to be connected or coupled to the supply lines in this location.

In accordance with another further development of the invention, double carriages for receiving two fitting units are arranged on the outer rails. If the local conditions should make this possible, this development of the invention significantly reduces the length of the shifting platform. However, in that case, the centering lines with the roller table rollers near the stands must be moved further away from the rolling line.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
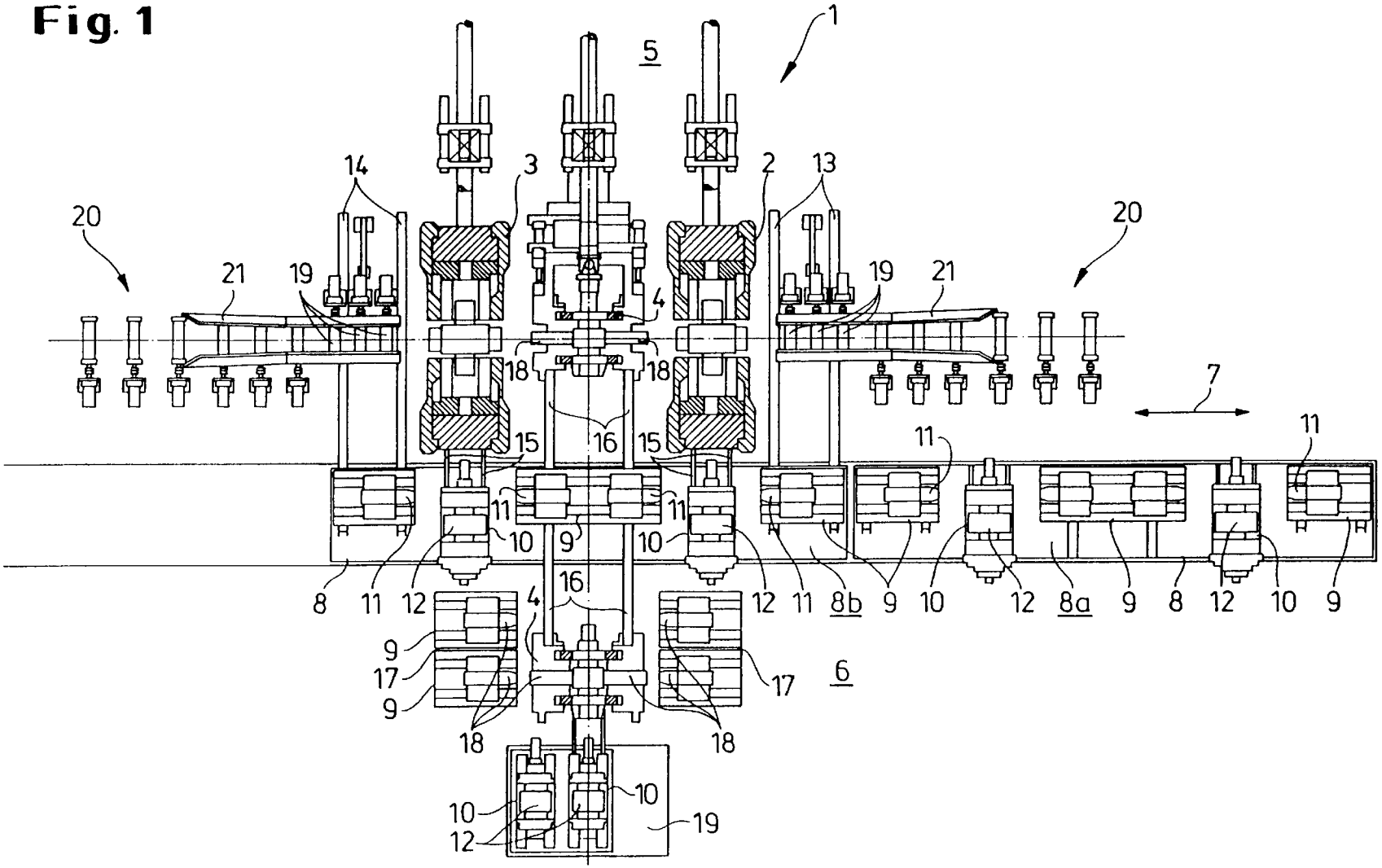
FIG. 1 is a top view of a complete rolling train composed of three stands and provided with exchange devices for the roll sets and the guide fittings or web guides of the stands.
Figure 2:
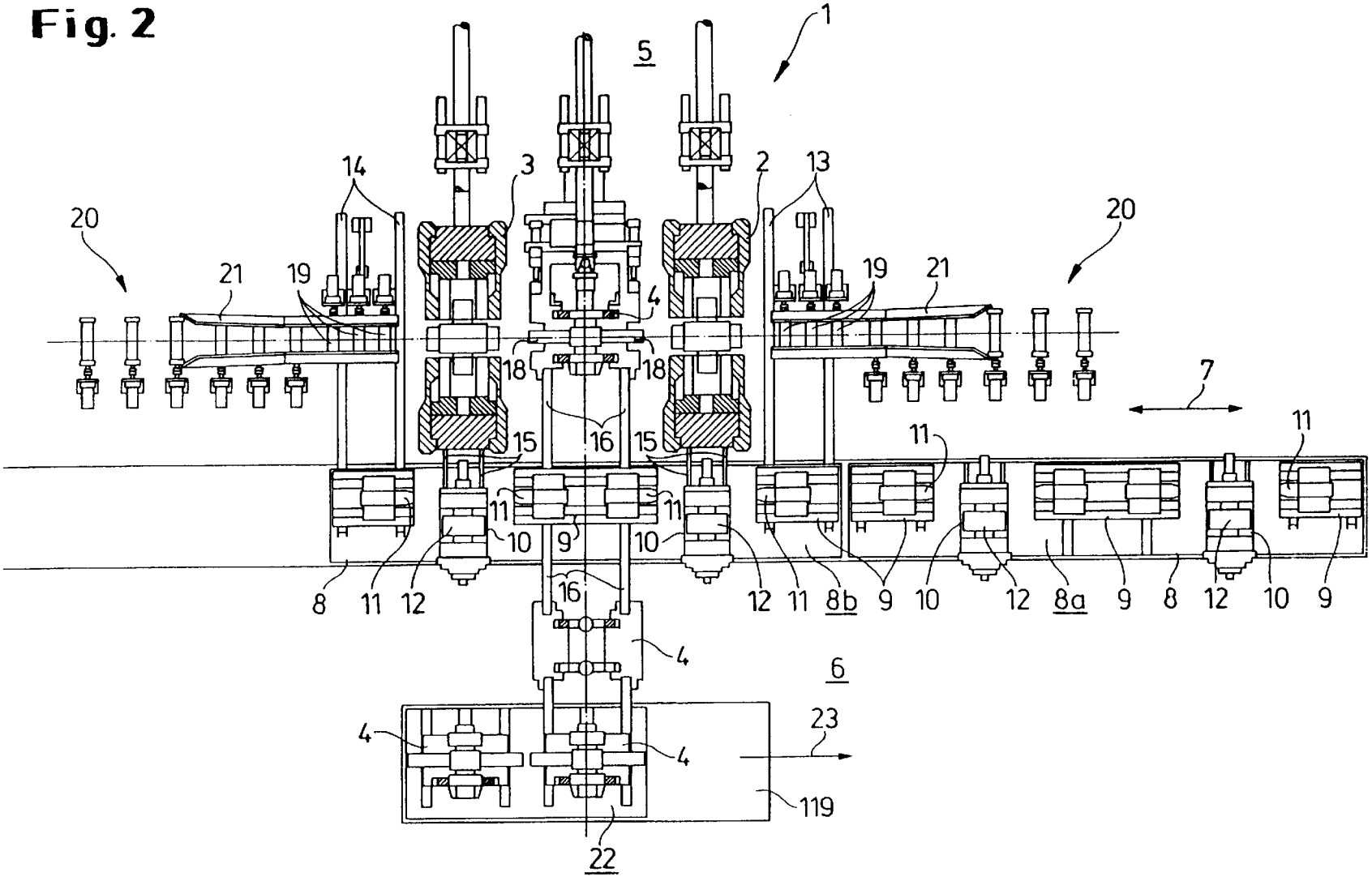
FIG. 2 is a top view of the rolling train according to FIG. 1, with a completely exchanged middle stand constructed as an edging stand.
Figure 3:
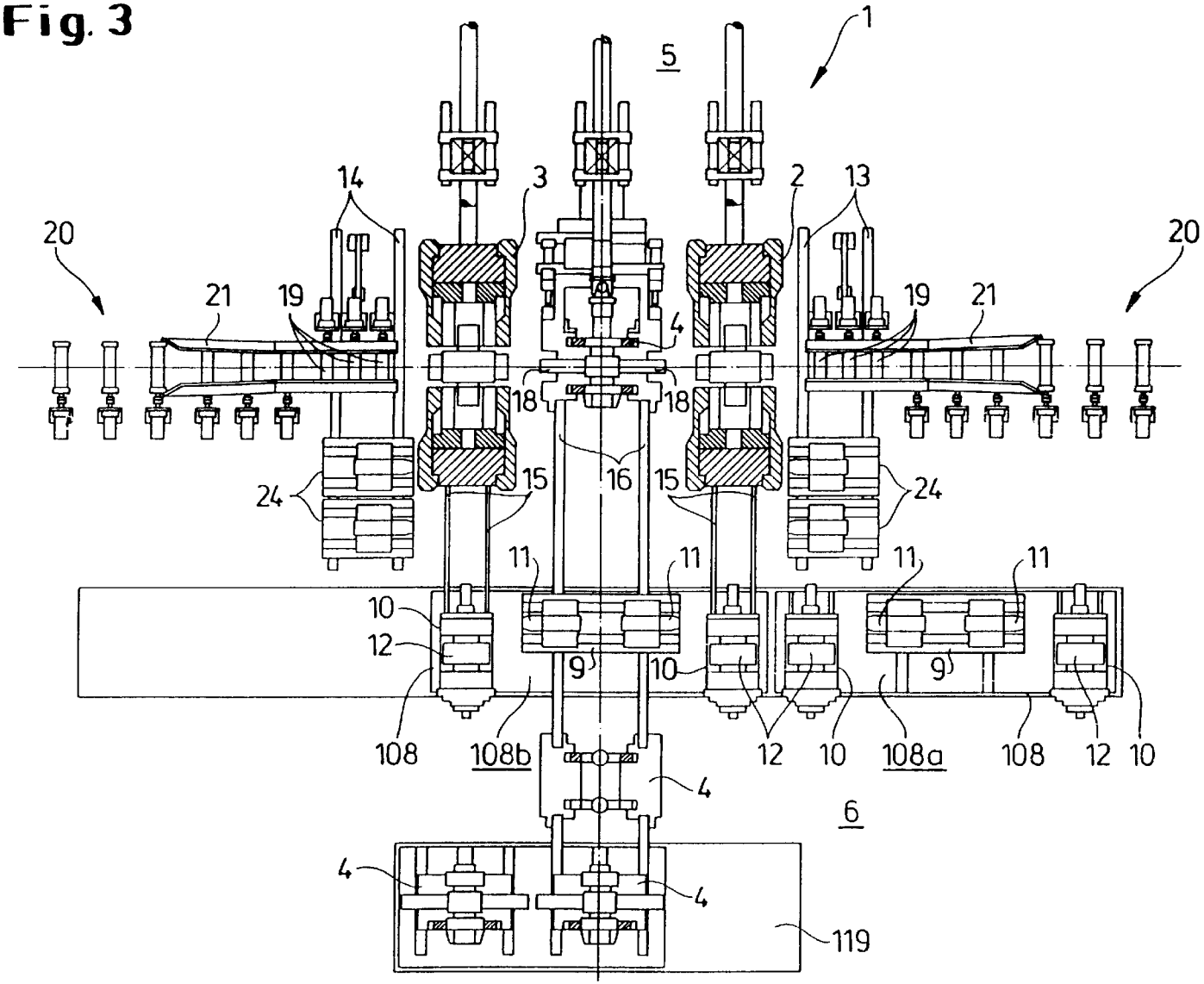
FIG. 3 is a top view of the rolling train of FIG. 2, wherein double carriages for always two guide fittings are provided at the outer sides of the respectively outer stands.

The rolling train 1 shown in FIGS. 1 to 3 is composed of three stands, namely the outer universal stands 2 and 3, shown schematically as partial sectional views in the drawing, and an edging stand 4 arranged between the universal stands 2 and 3. On the drive side 5, the stands 2, 3 and 4 are connected to drives which are not illustrated in detail, but are well known in the art.

On the operator side 6, a shifting platform 8 is arranged so as to be moveable in rolling direction and against the rolling direction in accordance with double arrow 7. The shifting platform 8 is composed of platform portions 8*a* and 8*b* and exchange carriages 10 for the guide fittings 11 and for roll exchange sets 12 are placed on the platform 8.

Rails for roll set carriages 10 and for the guide fitting exchange carriages 9 are provided on the shifting platform 8 or platform portions 8*a*, 8*b*. Specifically, outer rails 13 and 14 extend along the outer sides of the housings of the outer stands 2 and 3 toward the drive side 5, and middle rails 15, on which the roll set carriages 10 can be moved in an out, extend from each outer stand 2 and 3 toward the operator side 6. Finally, central rails 16 are provided for the edging stand 4, wherein the end portions of the central rails 16 are located on the operator side 6 of the rolling train 1 next to the shifting platform 8 or platform portions 8*a*, 8*b*. Arranged in this end region are oppositely located exchange platforms 17 for fittings 18 of the edging stand 4 and an exchange platform or shifting platform 19 for exchange carriages 10 of the roll sets 12. For clearing the path for shifting the guide fitting exchange carriages 9 into the respective assembly position, the first three rollers 19 of the roller table 20 near the stand are arranged so as to also be moveable on the outer rails 13 together with the guide members 21.

The exchange, i.e., the change of the guide fittings or the web guides 11 of the universal stands 2 and 3 and of the fittings 18 of the edging stand 4 and the change of the roll sets 12, is carried out in such a way that the roller table rollers 19 together with the guide members 21 are moved outwardly toward the drive side 5 from the position shown in FIG. 1. As soon as the edging stand 4 has been moved into its position illustrated in FIG. 1 of the operator side, the guide fittings of the universal stands 2 and 3 are completely exposed and can be disassembled. As illustrated in the disassembly situation of FIG. 1, the guide fittings of the universal stands 2 and 3 can be moved on the platform 8*b* of the shifting platform 8 in the same manner as the carriages 10 of the universal stands 2 and 3 with the roll sets 12. It is then merely necessary to move the shifting platform 8 in the rolling direction, i.e., in the direction of the double arrow 7 pointing toward the left as shown in the drawing, until the platform portion 8*a* provided with the new guide fittings 11 and roll sets 12 has reached the position previously assumed by the platform portion 8*b* in which all exchange carriages 9 or roll sets 12 of the platform portion 8*a* are moved into a middle position in relation to the universal stands 2 and 3 in which the outer rails 13 for the guide fitting exchange carriages 9 are simultaneously located in alignment with the stands 2 and 3. It is then possible by shifting the exchange carriages 9 to move the guide fittings 11 into the assembly position toward the drive side and to move the roll sets 12 into the stands 2 and 3. As soon as the assembly is concluded, the edging stand 4 provided outside of the shifting platform 8 with guide fittings 18 or with new roll set 12 is again moved into the rolling line, so that operation can be resumed. When refitting the edging stand 4, the exchange platforms 17 or the shifting platforms 19 have been positioned in the same manner, i.e., after the disassembly of the old guide fittings 18 or the removal of the old roll set 12, the new devices are positioned by moving them and are assembled.

The configuration of the rolling train according to FIG. 2 corresponds to the previously described embodiment, so that the same structural components are provided with the same reference numerals; in addition, the explanation provided above with respect to the exchange of the guide fittings 11 and the roll sets 12 of the universal stands 2 and 3 applies also to this embodiment. However, a difference is the fact that the edging stand 4 is exchanged completely. For this purpose, a shifting platform 119 extending parallel to the shifting platform 8 has two locations, i.e., an empty location 22 which, however, in FIG. 2 is already occupied with the edging stand 4 to be exchanged, and a positioning location 23 for a new edging stand which has previously already been completely equipped. By displacing the shifting platform 119 in the direction of arrow 23, the completely newly equipped edging stand 4 is placed in a position in alignment with the central rails 16, and consequently, can be moved on these rails into the space between the universal stands 2 and 3. Instead of changing the stand completely, an alternative embodiment provides that only a housing portion is moved in and out together with the rolls.

In FIG. 3 of the drawing, structural components already described above are provided with the same reference numerals. In contrast to the embodiment of FIG. 2, the shifting platform 108; 108*a*, 108*b* of the rolling train 1 shown in FIG. 3 can be constructed with a much shorter length. This is because double carriages 24 are arranged on the outer rails 13, 14 provided for the universal stands 2, 3, wherein, consequently, the double carriages 24 are capable of positioning the prepared new guide fittings for assembly after receiving the removed old guide fittings 11. Thus, the movement of the double carriages 24 is separate from the displacement movements of the platform 108; 108*a*, 108*b*, which now only receives the roll sets 12 and the exchange carriages 9 of the inner guide fittings of the universal stands 2 and 3.

While specific embodiments of the invention have been shown and described in detail to illustrate the inventive principles, it will be understood that the invention may be embodied otherwise without departing from such principles.

I claim:

1. A rolling train, particularly tandem stand group, comprising three roll stands including two outer stands and a middle stand between the two outer stand, comprising means for moving the middle stand transversely of a rolling line out of the stand group for changing a roll set and guide fittings of the middle stand, and a shifting platform with fittings placed on exchange carriages, wherein the shifting platform is moveable on an operator side in rolling direction, further comprising outer rails extending in an exchange position on outer sides of housings of the outer stands toward a drive side and central rails extending in alignment with the middle stand transversely of the shifting platform in the direction of the operator side, wherein the central rails protrude beyond the shifting platform, further comprising middle rails for each outer stand extending toward the operator side, wherein the outer stands comprise centering guide members arranged in the rolling direction in front of and following the outer stands, and wherein roller table rollers near the stands are moveable together with the centering guide members on the outer rails toward the drive side.

2. The rolling train according to claim 1, wherein the outer stands are universal stands and the middle stand is an edging stand.

3. The rolling train according to claim 1, wherein the central rails have end portions located adjacent the shifting platform, further comprising exchange platforms on the central rails for fittings and roll sets of the middle stand.

4. The rolling train according to claim 1, wherein the central rails have an end portion located adjacent the shifting platform, further comprising another shifting platform for a replacement middle stand provided on the end portion of the central rails.

5. The rolling train according to claim 1, further comprising double carriages on the outer rails for receiving two fitting units.

* * * * *